US005383546A

United States Patent [19]

Mulder

[11] Patent Number: 5,383,546

[45] Date of Patent: Jan. 24, 1995

[54] DEVICE FOR THE DETECTION OF A FOREIGN BODY IN A COIN CHANNEL

[75] Inventor: Arjen J. Mulder, Manubach, Germany

[73] Assignee: NSM Aktiengesellschaft, Bingen, Germany

[21] Appl. No.: 46,669

[22] Filed: Apr. 13, 1993

[30] Foreign Application Priority Data

Apr. 14, 1992 [DE] Germany ..... 4212499
Sep. 21, 1992 [DE] Germany ..... 4231534

[51] Int. Cl.[6] ..... G07D 5/10; G07F 3/02
[52] U.S. Cl. ..... 194/203; 194/331
[58] Field of Search ..... 194/202, 203, 328, 331

[56] References Cited

U.S. PATENT DOCUMENTS

| | | | |
|---|---|---|---|
| 3,998,309 | 12/1976 | Mandas et al. | 194/203 |
| 4,089,400 | 5/1978 | Gregory, Jr. | 194/331 X |
| 4,172,222 | 10/1979 | Eglise | 194/331 X |
| 4,546,868 | 10/1985 | Gregory, Jr. | 194/203 |
| 4,666,027 | 5/1987 | Ostroski et al. | 194/203 |
| 5,236,074 | 8/1993 | Gotaas | 194/331 |

FOREIGN PATENT DOCUMENTS

| | | | |
|---|---|---|---|
| 0070353 | 1/1983 | European Pat. Off. . | |
| 0311554 | 4/1989 | European Pat. Off. . | |
| 0416932 | 3/1991 | European Pat. Off. | 194/331 |
| 3711941 | 10/1988 | Germany | 194/331 |
| 59-17691 | 1/1984 | Japan | 194/331 |
| 2071381 | 9/1981 | United Kingdom . | |
| 2071382 | 9/1981 | United Kingdom | 194/331 |
| 2212313 | 7/1989 | United Kingdom | 194/331 |
| 2224150 | 4/1990 | United Kingdom . | |
| 9106072 | 5/1991 | WIPO . | |

*Primary Examiner*—Michael S. Huppert
*Assistant Examiner*—Scott L. Lowe
*Attorney, Agent, or Firm*—Dilworth & Barrese

[57] ABSTRACT

For detecting a foreign body, as, for instance, a thread (3) or a wire in a coin channel (10) or for the recognition of the edge outline of coins moving along the guide channel, a photoelectric detector (1, 2) monitors the coin channel (10) (FIG. 1).

16 Claims, 2 Drawing Sheets

DEVICE FOR THE DETECTION OF A FOREIGN BODY IN A COIN CHANNEL

BACKGROUND OF THE INVENTION

The invention relates to a device for the detection of a foreign body as for instance a thread or a wire in a coin channel or the recognition of the edge mill of coins moving along the guide channel.

Automatic vending machines or gambling machines may be tampered with by inserting a coin hanging on a thread into the coin slot so that the coin can be pulled out with the thread as soon as the coin has caused a signal for a genuine coin to be produced so that goods are supplied or some operation in a game enabled.

SUMMARY OF THE INVENTION

One object of the invention is to provide a device of the type initially mentioned which in a reliable manner renders possible recognition of foreign bodies in the coin channel.

In accordance with the invention this object is to be attained by the provision of a photoelectric detector for monitoring the coin channel. If there is a thread in the coin channel, it will cast a shadow or will cause some other form of interference in the light ray to be received by the receiver with the result that processing of the signals of the photoelectric detector in a microcomputer or an evaluating electronic system will betray the presence of a foreign body in the coin channel and will cause an alarm signal to be given.

In accordance with the invention the source and the receiver of the photoelectric detector are arranged on the top of the coin channel. Such a reflection renders possible furthermore the recognition of the edge outline of coins. Dependent on whether the coin moving through the channel has a smooth edge or milled one, certain types of reflection will be produced which may be processed by the receiver to produce corresponding signals, which can be processed in a following electronic processing unit.

Owing to the sensitivity to thermal effects of the components of the photoelectric detector and to the resulting temperature characteristic here may be variations in measurement of the signals of the photocurrent of the phototransistor employed as a receiver and this may lead to spurious processing. In order to prevent spurious measurements or errors in processing of the photocurrent of the phototransistor, in accordance with one further development of the invention the photoelectric detector comprises a phototransistor, which is coupled via an amplifier and a feedback loop with the LED, and the diode current is measured at short intervals of time and the values of sequentially following measurements are monitored. If owing to the effects of temperature there are changes in the signals from the LED and the phototransistor, that is to say if for instance there is a variation in the light energy from the LED in the infrared range and accordingly in the level of the photocurrent as well, such variations in the signal will make themselves felt in the level of the diode current. In accordance with the invention the diode current is measured at short intervals of time following closely upon each other and in the millimeter range, those values not being used as valid measurement values, which are greater than variations to be expected owing to changes in temperature. If the measurements indicate that there are long departures in the values to be expected on the basis of the temperature characteristic this will be an indication that there is a foreign body, as for instance a thread, in the coin channel. In this respect it is assumed for the measurements that changes, which are due to temperature variations, in the measured values will take place in a matter of seconds, whereas the measurements performed one after the other, will take place in a matter of milliseconds so that signal variations as a consequence of temperature effects may be reliably distinguished. If a foreign body is introduced into the coin channel, as for instance a coin hanging on a thread, there will be sudden change in the signals measured which may be reliably distinguished from modifications in the signal due to the temperature characteristic of the components.

It is convenient if a resistor is associated with the LED current circuit, the voltage drop of respectively following measurements at such resistor being monitored. The voltages measured at the resistor are proportional to the diode current.

It is convenient furthermore if the phototransistor is connected with a constant current source. The voltage of the constant current source may be monitored by a microcomputer.

It is convenient as well if a multiplicity of sequentially following measurements are processed to produce an average value for the LED current or for the voltage drop and in the case of rapid changes in the LED current or of the voltage drop, which exceed the limits to be expected owing to the temperature characteristic, a failure signal is produced.

The photoelectric detector may be monitored by a computer. The radiation of the LED may also be controlled by a computer so that the receiver, preferably a phototransistor, holds its adjustment in the linear range. If the upper and lower limits set on adjustment or control of the photodiode are exceeded, the device will be switched to "failure". The adjustment of the device may be performed continuously so that there is an automatic adaptation to take care of temperature changes and any changes in the components.

The passage of coins through the machine will not interfere with the adjustments made, because the time of passage is short. If however owing to the presence of a thread in the coin channel there is a change in the signal, an alarm signal will be produced, since such changes are responsible for more rapid signal changes than those to be expected owing to the temperature characteristic.

BRIEF DESCRIPTION OF THE DRAWINGS

The following detailed descriptive disclosure relates to embodiments of the invention as illustrated in the accompanying drawings.

In FIG. 1 the reader will see a coin channel 10 which has a rectangular cross section. In the upper narrow top wall of the coin channel 10 a photoelectric detector is arranged, which comprises an infrared source 1 and an infrared receiver 2. If there is no thread or other foreign body in the coin channel 10, the receiver 2 will produce a constant level output signal as plotted in FIG. 2.

Figure 3:
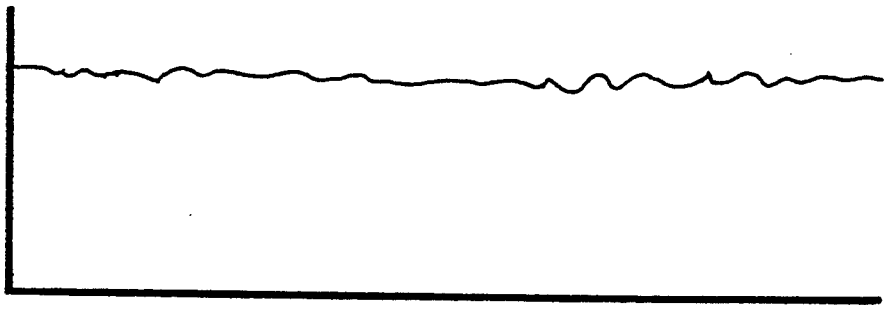
FIG. 3 is a graph of the output signal of the photoelectric detector when there is a thread in the coin channel.

If on the other hand there is a coin 4 hanging from a thread 3 in the coin channel, the thread will throw a shadow or it will interfere with the reflection of the light so that the infrared receiver 2 will supply the spiked and wavy output signal depicted in FIG. 3, which will be processed in an electronic processing unit.

Figure 1:
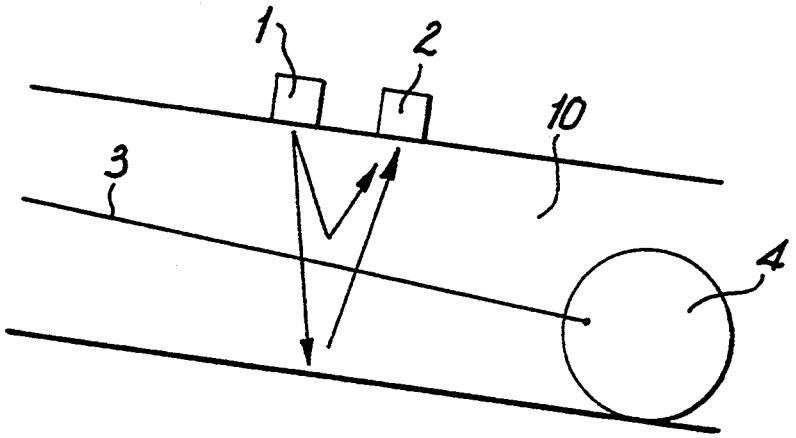
FIG. 1 shows diagrammatically a lateral elevation of the coin channel, which is monitored by a reflection-type photoelectric detector.
Figure 2:
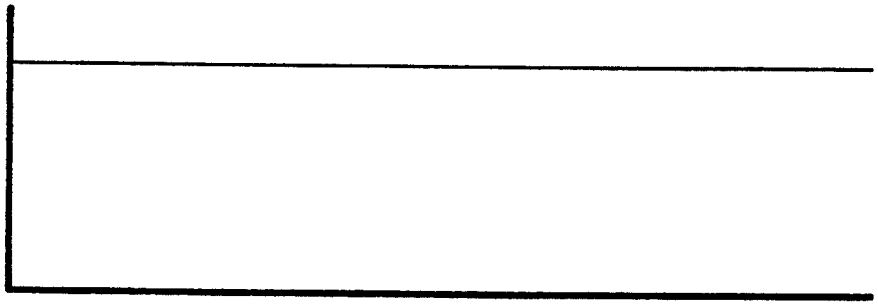
FIG. 2 is a graph of the output signal of the photoelectric detector when there is no foreign body such as a thread in the coin channel.
Figure 4:
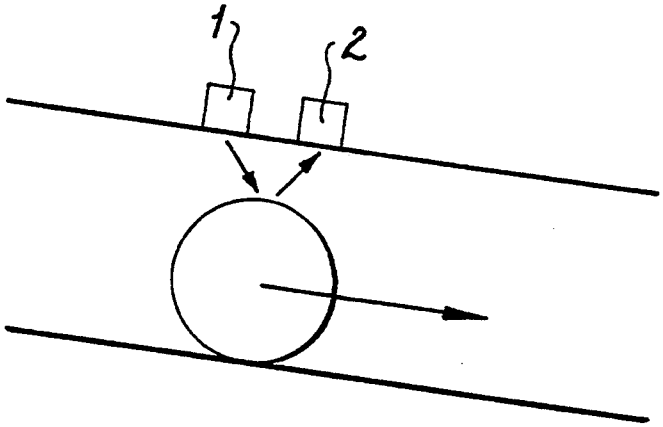
FIG. 4 shows the monitoring of the edge outline of coin moving through the channel.

The reflection-type photoelectric detector illustrated in FIG. 1 for monitoring the coin channel 10 can be employed as well for responding to the edge outline of coins in the manner depicted in FIG. 4. Reflection signals typical for the edge will be obtained, from which the processing electronic system may recognize the edge.

Figure 5:
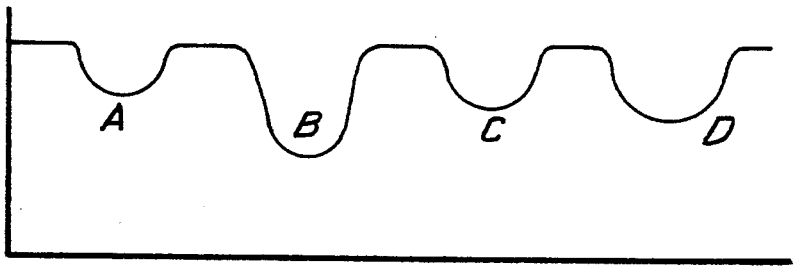
FIG. 5 shows in a graph of signals produced by different coin edges.

Typical signals are depicted in FIG. 5.

The signal A is for instance produced by a dark, smooth coin edge, as present for instance on a German 10 Pfennig coin.

The signal B is typical for the edge of a German 1 DM coin.

The signal C is obtained on examination of a coin with a milled edge.

The signal D is produced from a coin whose edge has been paired.

Figure 6:
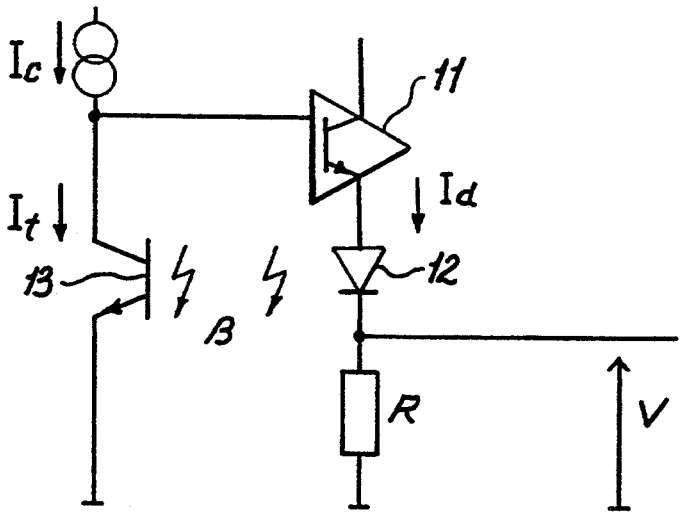
FIG. 6 shows a circuit for the photoelectric detector.

On the basis of the diagrammatic FIG. 6 the function and the manner of monitoring by the photoelectric detector will be described in more detail.

A current amplifier 11 amplifies the current Ic−It, Ic being the current maintained constant by a constant current source, and It is the phototransistor current. The amplifier output current (LED current) Id may be determined as follows:

$$Id=A\ (Ic-It).$$

The LED 12 converts the current Id into infrared light. A part of such infrared light impinges on the phototransistor 13. If only linear dependencies are taken into account, the phototransistor current will then be equal to:

$$It=\beta\ Id.$$

Then we have:

$$Id=A\ (Ic-\beta Id)$$

and $$Id=A\ Ic/(1+\beta A).$$

If the current amplification is large, we will have $$Id\approx Ic/\beta,$$

wherein $\beta$ is a measure for the light coupling. If only a small quantity of light reaches the phototransistor, the factor $\beta$ will be small and consequently Id will be large.

The current Id is measured across the resistor R:

$$V=R\ ID=Ic/\beta.$$

If now an object is held in the ray path, as for instance wires or coins, the factor $\beta$ will be smaller.

If the LED and the phototransistor are arranged optically separated on one side of the coin channel, a thread or a coin will cause reflection of light, the factor $\beta$ then being larger. Accordingly the voltage V will decrease.

The voltage $V=Ic/\beta$ is supplied to an analog/digital converter and then processed in a microcomputer.

Changes in the voltage V may be additionally caused by the temperature characteristics of the components. In order to avoid spurious readings owing to thermal effects, it is assumed that signal changes caused by variations in temperature proceed slower than changes in the signals, which are caused by objects present in the coin channel, such as coins or threads.

The monitor of the signals representing measurement may take place in the following manner:

By measuring the voltage V at the resistor R repeatedly a mean value for the voltage is derived and is utilized for initializing measurement.

If from the sequentially performed measurements it is apparent that the change in the measured value is small, the new measurement of the voltage is accepted for ascertaining the mean value of the voltage, since this measurement is accepted as being a good or valid measurement.

If a following measurement exceeds limiting values, which are not exceeded owing to changes in temperature, this measurement is not taken into account and is not utilized for deriving the mean value or average. Further measurements are performed.

If sequentially following measurements involve exceeding the predetermined limit values, they can no longer be interpreted as spurious measurements. Such changes in the results of measurement are then interpreted as coming from objects present in the coin channel, such as threads or wires and an alarm signal is produced.

I claim:

1. Device for detecting a foreign body in a coin channel or recognizing edge outline of coins moving along the channel, comprising a photoelectric detector comprising a source and receiver and arranged on top of the channel, the photoelectric source comprising an LED and the photoelectric receiver comprising a phototransistor, an amplifier through which the phototransistor is coupled with feedback to the LED, means for measuring diode current at short intervals, means for monitoring the sequential measurements and determining, by a plurality of the sequential measurements, a mean value of LED current, and means for providing a failure signal in the case of a rapid charge in the LED current which exceeds limits due to temperature characteristics.

2. The device as claimed in claim 1, additionally comprising a microcomputer or an evaluating electronic system coupled to the photoelectric detector for processing signals therefrom.

3. The device as claimed in claim 1, additionally comprising a constant current source connected with the phototransistor.

4. The device as claimed in claim 3, additionally comprising a microcomputer for monitoring the voltage of the constant current source.

5. The device as claimed in claim 1, wherein said means for producing a failure signal are arranged to emit signal failure upon presence of a thread which is the foreign body in the channel.

6. The device as claimed in claim 1, wherein said measuring means measure the diode current at intervals in the range of milliseconds.

7. The device as claimed in claim 1, wherein said monitoring/determining means include means for determining whether a discrete measured value exceeds a limit based upon the calculated mean value, and means for recalculating the mean value utilizing the discrete measured value if the same does not exceed the limit, and said producing means are arranged to produce the failure signal if a plurality of discrete measured values exceeds the limit.

8. The device of claim 1, being arranged to continuously adjust sensitivity of the photoelectric detector based upon temperature within the coin channel.

9. Device for detecting a foreign body in a coin channel or recognizing edge outline of coins moving along the channel, comprising a photoelectric detector comprising a source and receiver and arranged on top of the channel, the photoelectric source comprising an LED and the photoelectric receiver comprising a phototransistor, an amplifier through which the phototransistor is coupled with feedback to the LED, a resistor arranged in a current circuit including the LED, means for measuring voltage drop across the resistor at short intervals, means for monitoring the sequential measurements and determining, by a plurality of the sequential measurements, a mean value for the voltage drop, and means for producing a failure signal in the case of a rapid change in the voltage drop which exceed limits due to temperature characteristics.

10. The device as claimed in claim 9, additionally comprising a constant current source connected with the phototransistor.

11. The device as claimed in claim 10, additionally comprising a microcomputer for monitoring the voltage of the constant current source.

12. The device as claimed in claim 9, additionally comprising a microcomputer or an evaluating electronic system coupled to the photoelectric detector for processing signals therefrom.

13. The device as claimed in claim 9, wherein said means for producing a failure signal are arranged to emit signal failure upon presence of a thread as the foreign body in the channel.

14. The device as claimed in claim 9, wherein said measuring means measure the voltage drop across the resistor at intervals in the range of milliseconds.

15. The device as claimed in claim 9, wherein said monitoring/determining means include means for determining whether a discrete measured value exceeds a limit based upon the calculated mean value, and means for recalculating the mean value utilizing the discrete measured value if the same does not exceed the limit, and said producing means are arranged to produce the failure signal if a plurality of discrete measured values exceeds the limit.

16. The device of claim 9, being arranged to continuously adjust sensitivity of the photoelectric detector based upon temperature within the coin channel.

* * * * *